US011091891B1

(12) United States Patent
Kelly

(10) Patent No.: US 11,091,891 B1
(45) Date of Patent: Aug. 17, 2021

(54) PLASTIC RETRIEVAL PROCESS AND APPARATUS

(71) Applicant: Kieran Kelly, McKane, PA (US)

(72) Inventor: Kieran Kelly, McKane, PA (US)

( * ) Notice: Subject to any disclaimer, the term of this patent is extended or adjusted under 35 U.S.C. 154(b) by 0 days.

(21) Appl. No.: 16/799,812

(22) Filed: Feb. 24, 2020

(51) Int. Cl.
*E02B 15/10* (2006.01)

(52) U.S. Cl.
CPC ..... *E02B 15/10* (2013.01)

(58) Field of Classification Search
None
See application file for complete search history.

(56) References Cited

U.S. PATENT DOCUMENTS 3,612,280 A * 10/1971 Fitzgerald ..... E02B 15/048 210/242.3
5,043,064 A * 8/1991 Abell ..... E02B 15/103 210/242.1
5,071,314 A * 12/1991 Jacobsen ..... F04D 15/0022 415/148
6,112,699 A * 9/2000 Saxby ..... A01K 80/00 119/213
10,767,330 B2 * 9/2020 Armanini ..... E02B 5/085
2004/0115003 A1 * 6/2004 Johnston ..... E02B 15/0807 405/63
2005/0087119 A1 * 4/2005 Pedersen ..... B63B 35/26 114/255
2009/0022549 A1 * 1/2009 Wartmann ..... E02B 3/023 405/60
2019/0271293 A1 * 9/2019 Carter ..... F03D 9/008
2020/0015464 A1 * 1/2020 Hystad ..... F04B 23/00

FOREIGN PATENT DOCUMENTS

WO WO 2020/113320 * 6/2020

* cited by examiner

*Primary Examiner* — Chester T Barry
(74) *Attorney, Agent, or Firm* — Richard K Thomson

(57) ABSTRACT

One or more nets can be suspended from beams extending from ships where they are towed through riparian waterways such as lakes and oceans to remove plastic waste from those waterways. In the instance of micro-bead removal, a pump can be utilized to move the waste from the end of the collection bag through a hose to the deck of the towing vessel. In the case of rivers, the net can be supported adjacent a riverbank using a plurality of posts. Fish excluders with exit flaps are employed to ensure no damage is done to wildlife within the riparian waterways.

5 Claims, 5 Drawing Sheets

PLASTIC RETRIEVAL PROCESS AND APPARATUS

This application claims the benefit of provisional applications 62/809,576 filed Feb. 23, 2019, 62/867,510 filed Jun. 27, 2019 and 62/879,767 filed Jul. 29, 2019 which are each incorporated by reference in their entirety.

BACKGROUND AND SUMMARY OF THE INVENTION

The present invention is directed to the field of preservation of the planet. More particularly, the present invention is directed to methods and apparatus for cleaning plastic waste from lakes, rivers, and oceans.

In the 1967 movie, The Graduate, "plastics" was a magic word. The flexibility and durability of plastics, was foreshadowed in 1967, and has since resulted in, billions of dollars being invested in development, manufacture and marketing of plastic products in virtually every industry on the globe.

The same "benefits" of plastics—flexibility and durability—threaten to inundate the earth and both its human and animal kingdoms, with plastic products. Indeed, the earth is literally drowning in plastic. Particularly, our rivers, lakes and oceans and the wildlife that once thrived there, are being choked out of existence. If something is not done, and done soon, the inhabitants of the earth's waterways and, indeed, the earth itself, will be in serious jeopardy.

The problem within our riparian water systems including lakes, rivers, and oceans resulting from mankind's disposal of plastic is the biggest environmental problem facing our planet today. Fish are becoming sterile due to ingestion of micro plastics; sea birds, sea turtles and sea mammals are dying by the tens of thousands daily due to this pollution problem. Something must be done, and done now, or humans in some countries will die due to starvation because of their dependency on seafood and/or fish from rivers and lakes, and their impending deprivation of their primary food source.

A first embodiment of the plastic retrieval method and apparatus of the present invention consists of single boat, or two boats, pulling nets through the water. The goal is to help clean up our ocean, lakes, and rivers of plastics in our oceans and waterways. The method uses a net attached to a long steel pipe or beam running straight out from the boat midships on one or both sides of the vessel. Attached to the steel boom is the net that will run out approximately 80 feet. The net will extend from the underside of the beam and the top of the net will be approximately 3 to 5 feet above the surface of the water. The net will go from the side of the boat out to the very outside tip of the beam. The bottom or underside of the net will be approximately 3-5 feet beneath the surface of the water. Alternatively, the net can be pulled behind a pair of boats. Similarly, the net can be spaced from the boat toward the outer end of the beam.

The net will be dragged through the water at approximately 1-8 knots, depending on the application. The net will scoop up the plastics and other trash in our waters; the net will eventually fill with plastic and will be taken onboard by hydraulic winches. Eventually, the accumulated plastic waste will be off-loaded to a barge or scow so the collection process may continue for as long as needed.

In a second embodiment, the trailing end of the net can be equipped with a pump and the accumulated waste can be pumped back onto the deck of the ship or into a bin on the deck. This embodiment works particularly well when the plastic waste involves micro-plastic beads filtered from the water using mesh placed in the tapering nets having a mesh size of 50 mm to 20μ, depending on the specifics of the waste being retrieved. In the micro-plastic application, the net is equipped with a tapered section every ten feet, or so, producing a 30% reduction in flow volume and a reducer positioned in the path initiating cavitation of the stream causing stirring that will reduce/eliminate blockage of the flow which would result from plastic buildup on the reducer.

Yet another embodiment is employed along the banks of streams and rivers. The net(s) can be positioned along the banks of the rivers and streams attached to poles with a frame holding open the mouth of each net. The river/stream flow carries the plastic waste into the mouth of the net where it is captured in the body of the net and removed from the waterway.

DETAILED DESCRIPTION OF THE PREFERRED EMBODIMENTS

Figure 1:
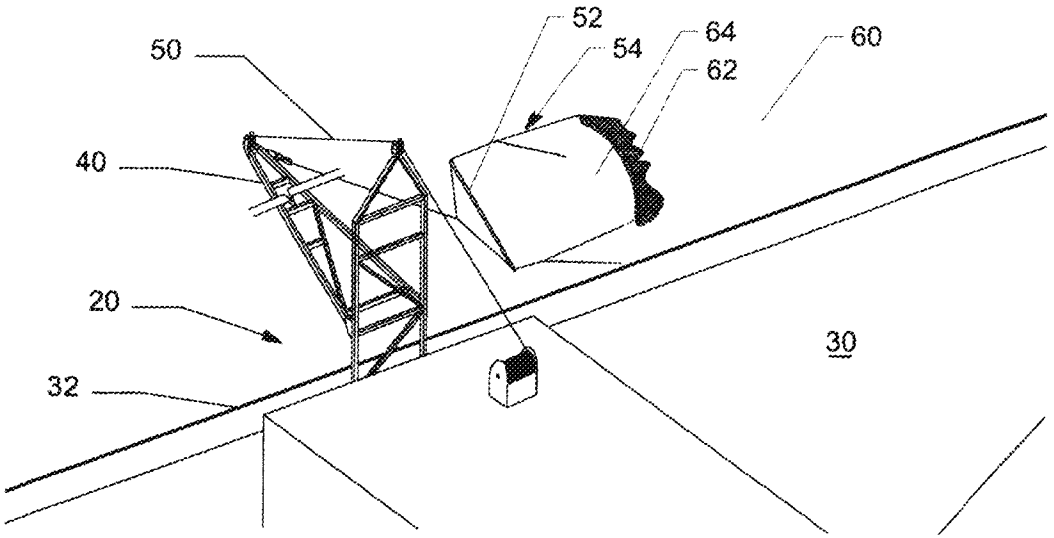
FIG. 1 depicts an exemplary collection net and mounting beam to suspend the net over the water to accomplish the method of the present invention.
Figure 2A:
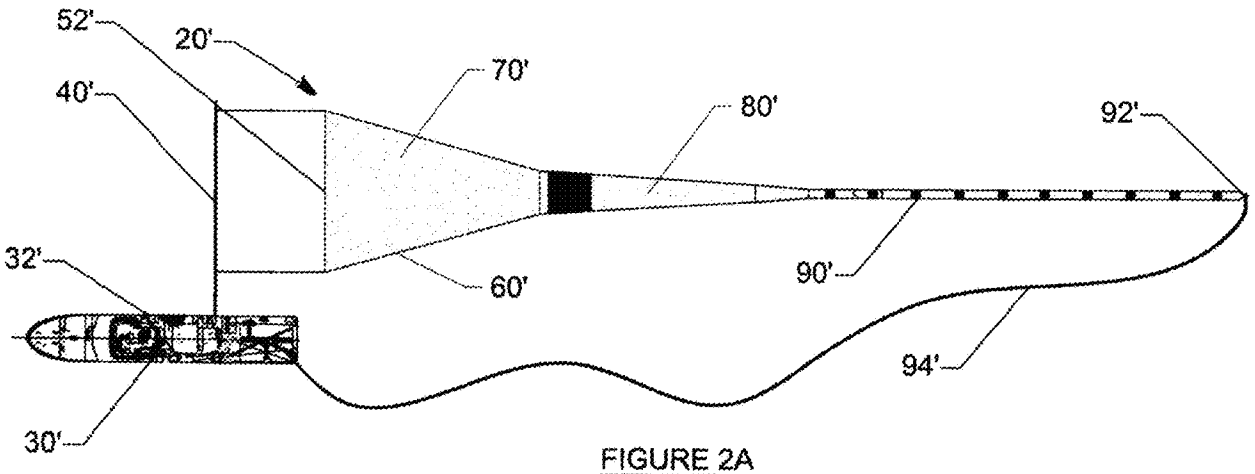
FIG. 2A is a second embodiment with a side-mounted net-supporting beam with a pump with a feed line for returning the accumulated plastic waste to the deck of the ship.
Figure 2B:
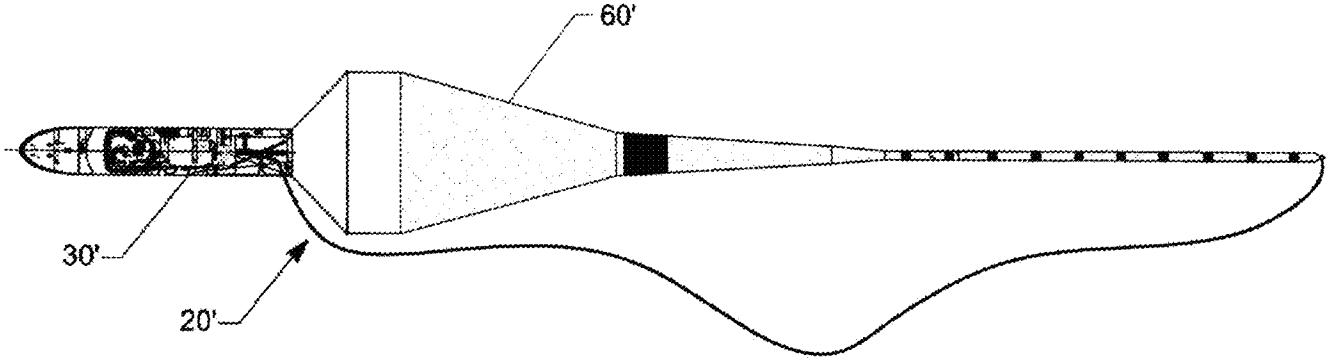
FIG. 2B is an alternate version of the second embodiment in which the collection net is towed directly behind the collection vessel.

A first embodiment of the plastic retrieval apparatus of the present invention is seen in FIG. 1 generally at 20. Apparatus 20 includes a ship 30 with a boom 40 extending laterally from first side 32. The boom extends outwardly from side 32 as much as 80 feet or more and cable 50 suspends a beam 52 which supports harness assembly 54 which holds the mouth of capture net 60 open. The top 62 of net 60 will be positioned 3-5 feet above the surface of the water with the bottom edge 64, similarly, being 3-5 feet below the surface. The mouth of the net is 8-10 feet tall and 30 feet wide. The net 60 will be pulled through the water at 1-8 knots to remove plastic and other waste from near the surface of a lake or ocean. When the net accumulates what is substantially a full load, it will be pulled onto the deck and replaced with a second empty net while the load in the full net is expelled.

Figure 3A:
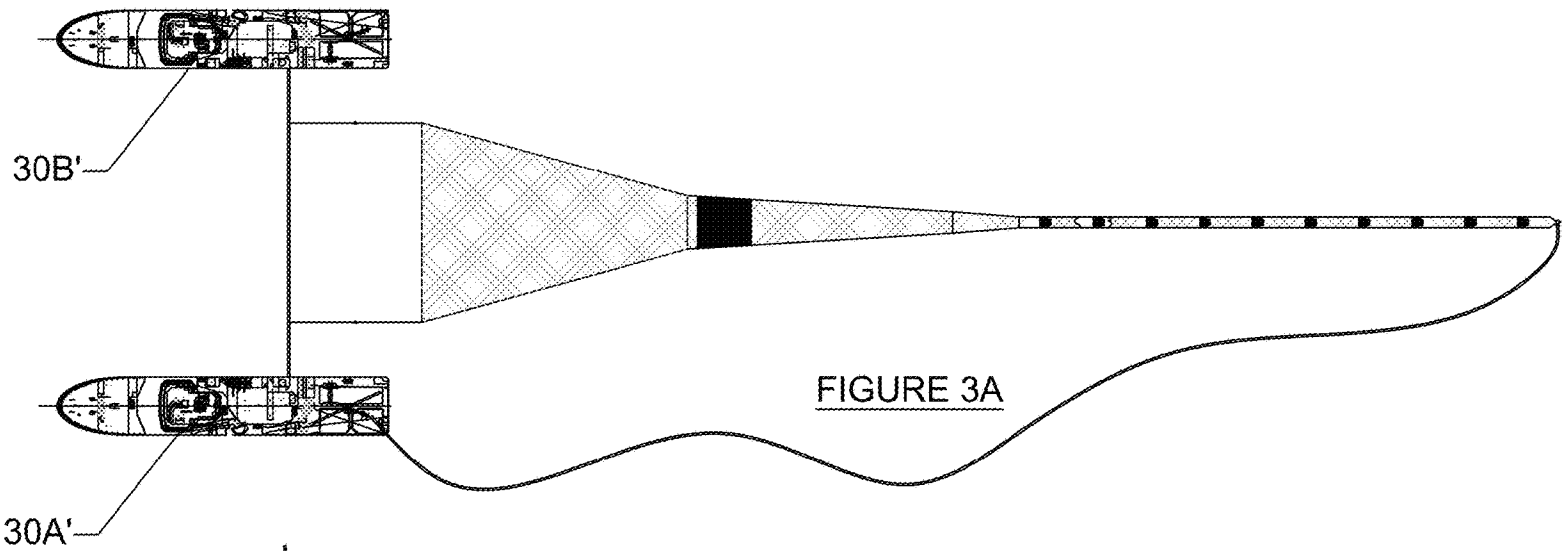
FIG. 3A is yet another embodiment in which a single capturing net is towed between two ships.
Figure 3B:
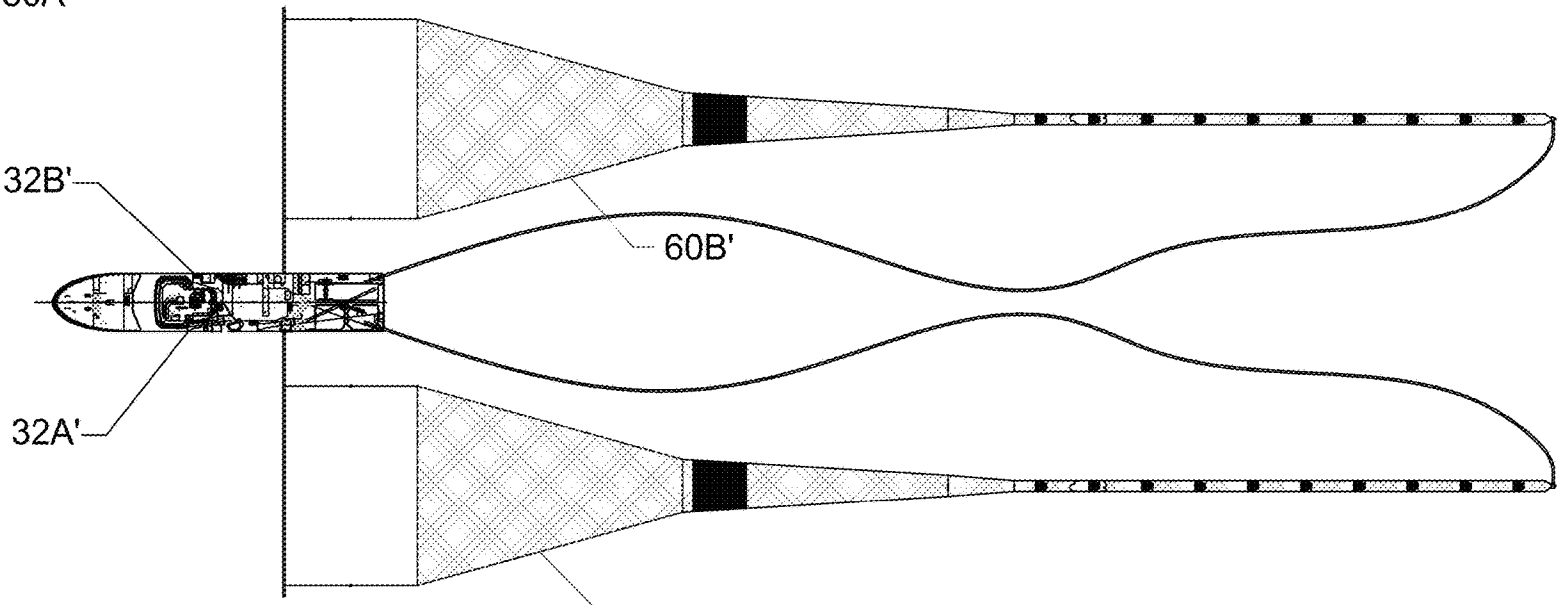
FIG. 3B depicts a single ship deploying two capturing nets, one from each side.
Figure 4:
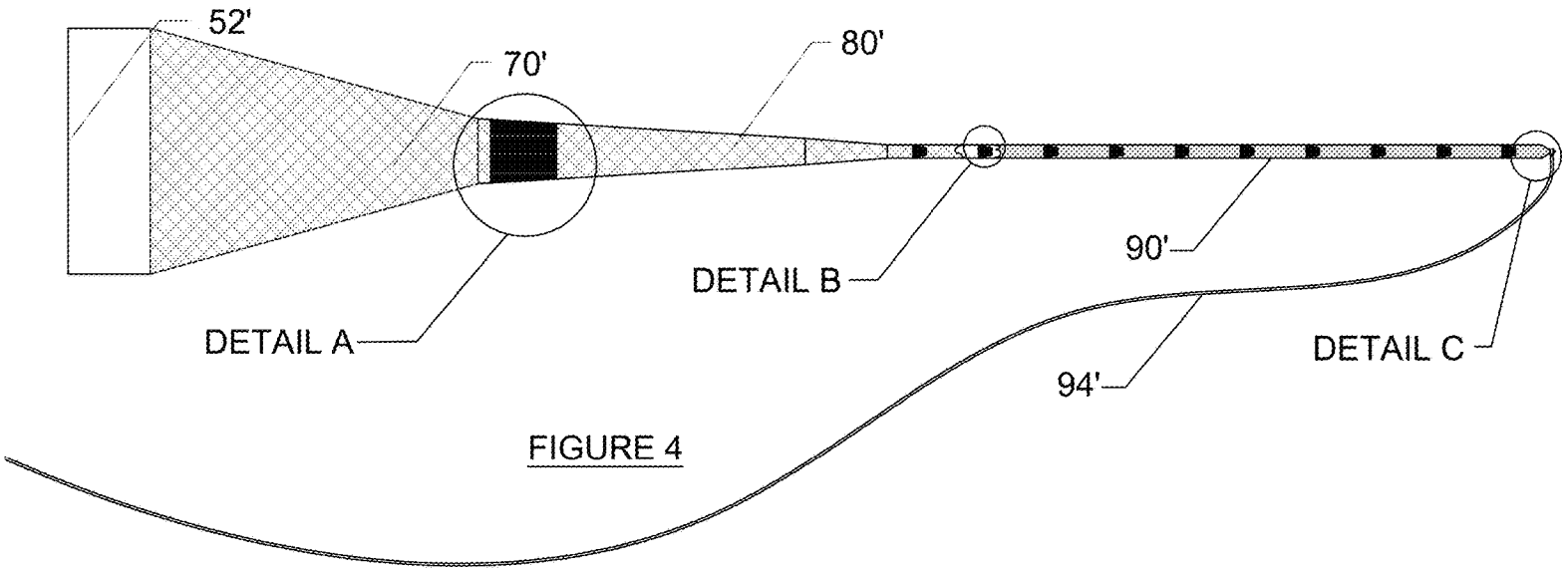
FIG. 4 is a view of a net used in the plastic removal method of the present invention.
Figure 4B:
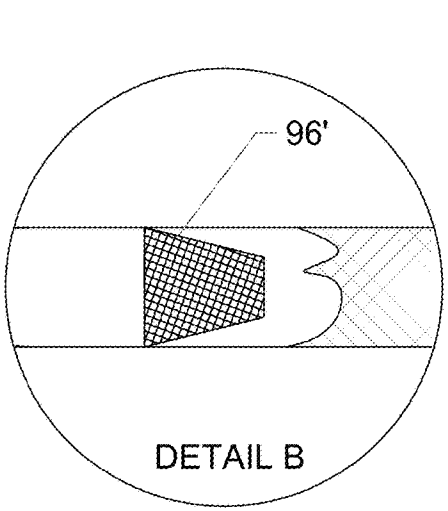
FIG. 4B is a detail of one of the plurality of reducers mounted within the end of the net.
Figure 4C:
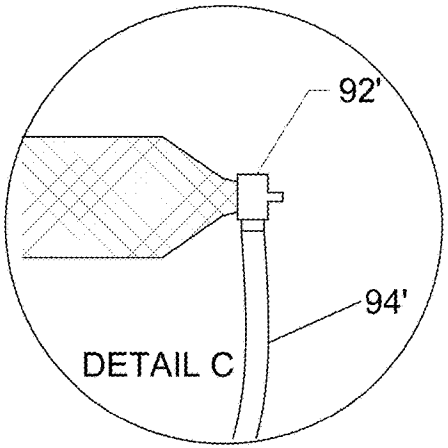
FIG. 4C is a detail of the pump secured to the very end of the bag.
Figure 4A:
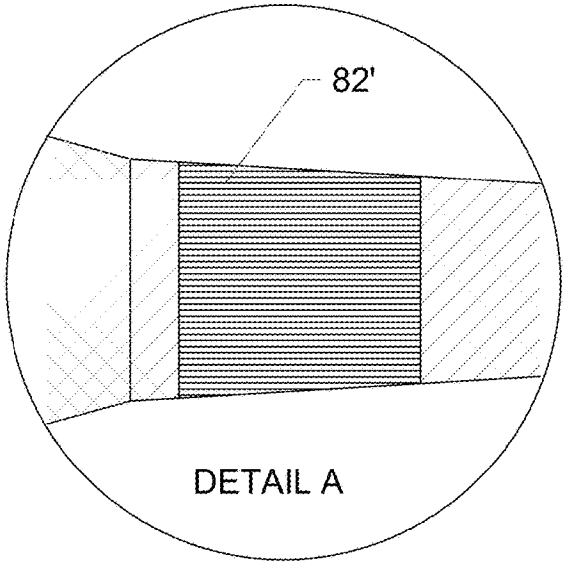
FIG. 4A is a detail of the fish excluder positioned at the forward end of the transition section.

A second embodiment of the plastic retrieval apparatus of the present invention is depicted in FIGS. 2A-3B generally at 20'. In this embodiment, net 60' is equipped with a converging section 70', a transition section 80', a tail end section 90' with a pump 92' feeding collected waste back to ship 30' via a hose 94'. The suspension beam 52' and harness employed with the first embodiment will typically be adapted for use with this embodiment, as well. This second embodiment is most beneficial when used to collect micro-plastic beads from the surface of the lake or ocean. However, it is also suitable for collection of plastic particles as large as a dinner plate. As shown in the various figures, the collection net 60' may be suspended from a boom 40' extending from the side 32' of a ship 30' (FIG. 2A), towed directly behind the ship 30' (FIG. 2B), pulled between two cooperating ships 30A' and 30B' (FIG. 3A), or a pair of nets 60A' and 60B' can extend from sides 32A' and 32B', respectively, (FIG. 3B).

Within transition section 80' is a fish excluder 82' with an exit flap to prevent fish from being caught in the net. In tail end section 90' are a plurality of reducers 96' which produce cavitation of the flow of the water/plastic waste stream causing stirring that eliminates the buildup or bridging of the micro-beads in the end section 90' such that flow to the pump 92' is continuous as is the feed through the hose 94'. This presumes a continuous intake at the mouth of the net 60'.

Figure 5B:
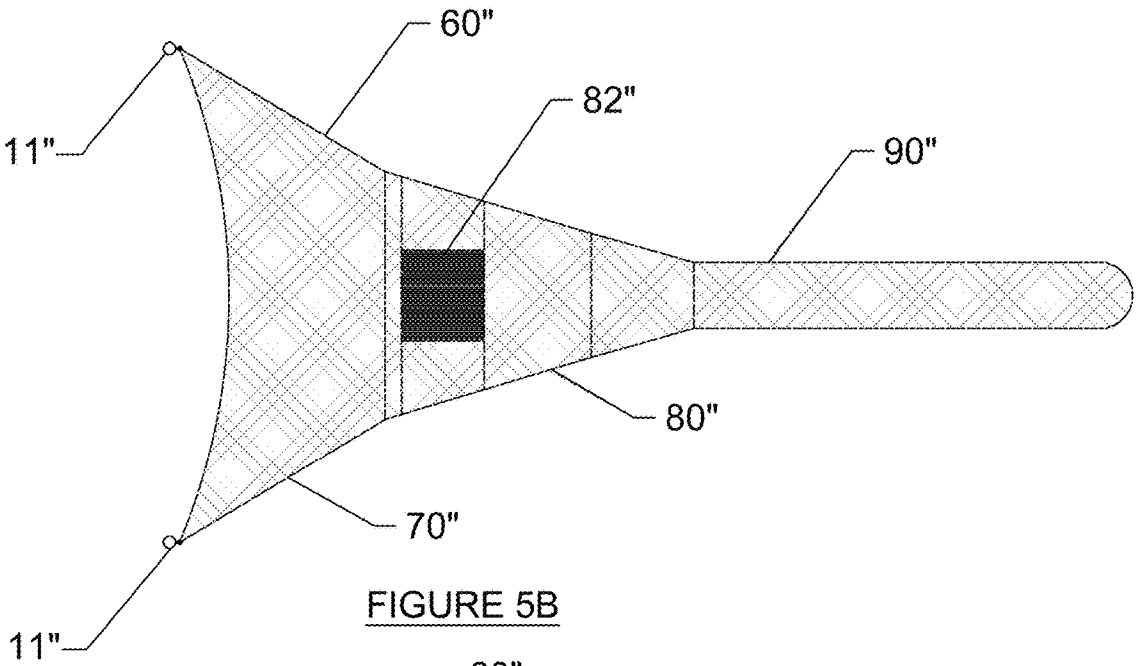
FIG. 5B is a top view of the net shown in FIG. 5A.
Figure 5A:
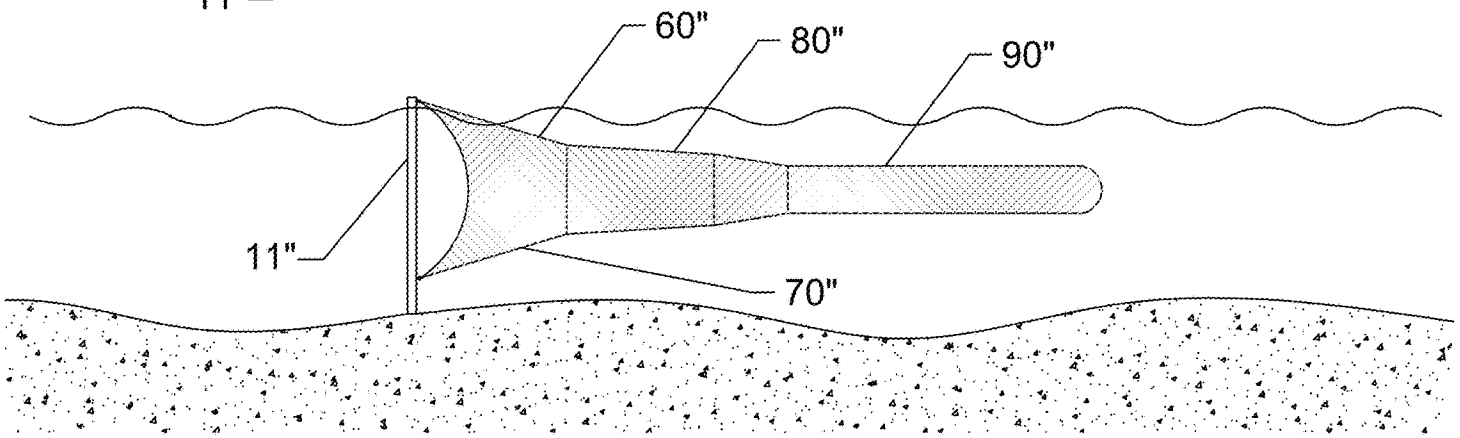
FIG. 5A is a schematic side view of a net mounted along a riverbank.

A third embodiment of the present invention is depicted in FIGS. 5A and 5B generally at 20". This embodiment is better suited for use in flowing riparian waterways such as rivers and streams. A plurality of posts 11" will support the open-mouthed net 60" along the shore of the waterway. The net 60" has features similar to those of the other embodiments including a converging section 70", a transition section 80" including a fish excluder 82", and a tail end or bag end section 90". Depending on the width of the waterway, multiple nets 60" can be mounted in juxtaposed position and/or on opposite banks, typically offset so as not to impede boat traffic on the waterway.

I claim:

1. Apparatus for removal of plastic waste from a riparian water system including oceans, rivers, streams and lakes, said apparatus comprising:

a) at least one net having
   i) an open mouth with a lower edge 3-5 feet below a surface of the riparian water system and an upper edge 3-5 feet above the surface of the water system,
   ii) a body portion extending rearwardly from said mouth, said body portion including
      1) a converging section,
      2) at least one transition section, and
      3) a tail end section;

b) attachment means for securing said net to at least one boat such that said net is towed through the riparian water system by said at least one boat;

c) a fish excluder in said transition section for permitting fish to swim out of said at least one net thereby not becoming entangled in said at least one net d) at least one reducer in said tail end section, said reducer producing cavitation which stirs plastic particles within said tail end section preventing bridging and clogging thereof upstream of said pump.

2. The apparatus for removing plastic waste of claim 1 further comprising a pump secured to the end of said tail end section, said pump having a hose attached thereto to pump plastic waste captured by said net through said hose back to a deck of the boat towing said net.

3. Apparatus for removal of plastic waste from a riparian water system including rivers, streams and lakes, said apparatus comprising:

a) at least one net having
   i) an open mouth,
   ii) a body portion extending rearwardly from said mouth, including
      1) a converging section,
      2) a transition section, and
      3) a tail end section;

b) first post means for suspending said at least one net stationarily along a shore of the riparian water system so as not to impede boat traffic on the waterway;

c) second post means for suspending said at least one net within the riparian water system, said at least one net stretched between said first and second post means with said mouth of said at least one net open in an upstream direction with a lower edge portion some 3-5 feet beneath a surface of said riparian water system and an upper edge portion above the surface of said riparian water system, said body portion extending rearwardly from said mouth.

4. The apparatus for removing plastic waste of claim 3 further comprising a fish excluder in said transition section for permitting fish to swim out of said at least one net thereby not becoming entangled in said at least one net.

5. A method for removal of plastic waste from navigable riparian water systems including rivers, streams and lakes, said apparatus comprising:

a) securing at least one first closed-ended net with a mouth open in an upstream direction with a lower edge portion some 3-5 feet beneath a surface of said navigable riparian water system and an upper edge portion extending above the surface of said navigable riparian water system to a first set of poles on a first side of the navigable riparian water system;

b) securing at least one second closed-ended net with a mouth open in an upstream direction with a lower edge portion some 3-5 feet beneath the surface of said riparian water system and an upper edge portion extending above the surface of said navigable riparian water system to a second set of poles on an opposing side of said navigable riparian water system, said at least one second net being longitudinally offset from said at least one first net within a riparian water system to avoid impeding navigation of said navigable riparian water system.

* * * * *